US005417122A

United States Patent [19]

Casey et al.

[11] Patent Number: 5,417,122

[45] Date of Patent: May 23, 1995

[54] SOIL SAMPLING SYSTEM WITH SAMPLE CONTAINER RIGIDLY COUPLED TO DRIVE CASING BY INFLATED GLAND

[76] Inventors: Michael B. Casey, Precision Sampling, Inc., 47 Louise St., San Rafael, Calif. 94901; Murray D. Einarson, Einarson Geoscience, Inc., 958 San Leandro Ave., Suite 900, Mountain View, Calif. 94043

[21] Appl. No.: 261,397

[22] Filed: Jun. 17, 1994

Related U.S. Application Data

[63] Continuation-in-part of Ser. No. 954,987, Sep. 30, 1992.

[51] Int. Cl.[6] ..... G01N 1/20; E21B 33/00

[52] U.S. Cl. ..... 73/864.44; 73/864.45; 277/34.6

[58] Field of Search ..... 73/864.44, 864.45; 175/20, 214, 58, 244, 249, 246; 277/34.6; 166/10, 11, 12

[56] References Cited

U.S. PATENT DOCUMENTS

| | | | |
|---|---|---|---|
| 2,611,437 | 9/1952 | Lynes | 166/10 |
| 2,630,865 | 3/1953 | Baker | 166/12 |
| 2,643,722 | 6/1953 | Lynes et al. | 166/10 |
| 2,872,230 | 2/1959 | Desbrandes | 288/6 |
| 4,357,992 | 11/1982 | Sweeney | 175/214 |
| 4,455,027 | 2/1984 | Baski | 277/34.6 |
| 4,518,050 | 5/1985 | Sollie et al. | 175/246 |
| 4,735,269 | 4/1988 | Park et al. | 175/244 |
| 4,770,030 | 9/1988 | Smith | 73/864.45 |

OTHER PUBLICATIONS

Advertising brochure—Christensen 94mm Wireline Core Barrel System.
Advertising brochure—Mobile Drill Basic Wireline Soil Sampling Systems.
Advertising brochure—CME Continuous Sample Tube System.
Advertising brochure—Aardvark Tigre Tierra Pneumatic Packers.
Operating Manual—Aardvark Tigre Tierra Pneumatic Packers.
Advertising brochure—Baski's Inflatable Fracker.
Advertising brochure—Diamond Drill.
Advertising brochure—Mobile Drill Overshot Wireline Soil Sampling Systems.
Advertising brochure—Diamond Drill BHR2 Wire Line Core Barrel.
Advertising brochure—Baski Inc. Flow Control Valve.
Advertising brochure—TAM International 2½" O.D. Modular Test Tool.
Advertising—TAM Inflatable Packers for Hydrological and Geotechnical Applications.
Advertising—Baski Catalog 4.
Swanson, Gloria, "Inflatable Packers", *Water Well Journal*, Apr. 1986, pp. 49–52.
Baski, "Getting the Most from Your Inflatable Packer", *Ground Water Age*, Nov. 1990, pp. 10–13.
Baski, H., "Hydrofracturing of Water Wells", *Water Well J.*, Jun. 1987, pp. 34–35.

*Primary Examiner*—Richard E. Chilcot, Jr.
*Assistant Examiner*—William L. Oen

[57] ABSTRACT

A fluid-coupled latch for a soil sampling system (including a sample barrel and a drive casing) includes an inflatable gland affixed to the sample barrel. When inflated, the latch engages the inner wall of the drive casing so that the sample barrel is held in a fixed position relative to the drive casing. The latch thus in effect rigidly couples the sample barrel to the drive casing so that the drive casing and sample barrel can be driven simultaneously into the soil while maintaining their initial relative positions. The pressure in the gland is regulated during sampling procedures. After the casing, barrel, and liners are advanced a selected depth into the soil, the latch is released by deflating the inflatable gland and the barrel and liners are removed using wire rope from a winch. The drive casing remains in the soil. An extension is attached to the drive casing. Empty sample liners are put into the sample barrel, and the sample barrel (with latch, inflation tubing, and wire rope attached) is lowered into the drive casing. The latch is then reactivated to secure the sample barrel. The drive casing, including extensions, and the latched sample barrel are driven further down into the soil. The procedure can be repeated until all desired samples are obtained. A clamp system allows the drive casing to be hydraulically retracted from the ground when sampling is finished.

11 Claims, 10 Drawing Sheets

SOIL SAMPLING SYSTEM WITH SAMPLE CONTAINER RIGIDLY COUPLED TO DRIVE CASING BY INFLATED GLAND

BACKGROUND OF THE INVENTION

This application is a continuation-in-part of a U.S. patent application, Ser. No. 07/954,987, filed Sep. 30, 1992.

The present invention relates to soil sampling systems and, more particularly, to a system for securing hollow-tubed soil samplers. A major objective of the present invention is to provide for more efficient collection of soil samples for chemical or physical analysis.

Contamination of soils is a major environmental concern. Toxic compounds can remain in the soil for years, and can seep into ground water, causing serious environmental and health problems. Because contamination is often located many feet below the surface, identifying and treating contaminated soils can be problematic.

A system for soil sampling such as the one described in the parent application includes a sampler and a driving rig. The sampler includes a casing and inner sample barrel, along with sample liners. A drive shoe, attached to the drive casing, eases the sampler into the soil.

The drive casing and sample barrel (with sample liners) are driven simultaneously into the ground. The barrel and liners are then removed, while the drive casing stays in place. New sample liners are placed in the sample barrel, and a new length of drive casing and an inner rod are attached. A drive head is attached to the top of the inner rods and the drive casing. In subsequent iterations, the liners and barrel, along with new lengths of drive casing and inner rod, are driven further distances into the ground.

To keep the sample barrel pressed against the drive shoe, the combined length of the sample barrel and inner rods must be precisely matched to the length of the drive casing. If they are not within 1/16", the sample barrel and sample liners can fail to seat securely against the drive shoe. If the barrel and liners are not seated securely against the drive shoe, driving the sampler into the ground will jostle it sideways, causing the edge of the sample barrel to lead, so that the soil will be pushed outwards rather than into the sample barrel. In this case, not only will the sampler fail to acquire the desired sample, but soil can be forced into the drive casing, which can cause jamming and interfere with retrieval of the sample barrel, and can necessitate cleaning before sampling can continue. However, it can be difficult to match the lengths of multiple threaded sections of drive casing with multiple threaded sections of inner rods. For example, when the sampler is at the full depth of 30 feet, there are nine 3' sections of inner rod and ten 3' sections of drive casing. It is difficult to maintain the cumulative errors in section length to within 1/16".

The inner rods can cause a host of other problems. They are heavy, and add to the difficulty of retrieving the sampler. Furthermore, they are very time consuming to use. Because they come in segments, as the sampler is being driven into the ground, the process must stop every three feet so that a new segment of inner rod can be screwed in to the existing inner rod segments, and the drive head reattached. The retrieval must stop every 3 feet when the sampling is complete and the sampler is being retrieved, so that each segment of inner rod can be unscrewed and removed. Thus, at maximum depth, the sampling must stop nine times to attach new segments of inner rods, and nine times again during retrieval to remove segments of inner rods.

A mechanical latch can be used to affix the sample barrel and liner in place, replacing the inner rods altogether. However, the sampling system uses a hydraulic hammer and/or a vibrator to drive the sampler into the ground. The vibrations can sometimes shake such a latch open, releasing the barrel and spoiling an entire round of sampling. Also, the vibrations can cause excessive wear on the latch, so that it must be replaced often, which is expensive and can lead to delays. In fact, the tight fit necessary increases the force translated to the latch and thus increases the wear. Furthermore, because the system has a thinner casing than single-rod systems, the vibrations are less attenuated than in other systems, further increasing the wear on the latch. In addition, a mechanical latch usually requires another connecting line to the surface to engage and disengage it, introducing another possible source of failure.

What is needed is a soil sampling system that forces the sample barrel and liner against the drive shoe and locks it in place without requiring the tight tolerances of inner rods, and that can withstand the vibrations of the sampling process.

SUMMARY OF THE INVENTION

In accordance with the present invention, a soil sampling system includes a fluid-coupled latch that uses an inflatable gland for locking a sample barrel and sample liners into place against a drive shoe. When latched, the sampler can be driven into the ground with the sample barrel and sample liners locked in proper position within the drive casing. The inner rods can thus be eliminated.

The soil sampling system includes a rig and a sampler. The rig includes drive systems, retrieval systems, and a latch controller. The sampler includes a drive casing assembly, a sample barrel, sample liners, and a fluid-coupled latch. The fluid-coupled latch includes the inflatable gland and, preferably, a mandrel for supporting the gland. The latch control system includes a gas source, which can be a gas canister, and a gas flow controller for controlling the flow of gas from the source to the gland. The gas flow controller operates a valve arranged for inflating and deflating the gland. In addition, a gas line couples the latch control system to the gland.

The mandrel can be attached to the top of the sample barrel or be otherwise rigidly coupled to the sample barrel. When deflated, the inflatable gland allows the mandrel, and thus the sample barrel, to move freely within the length of the drive casing. When inflated, the inflatable gland exerts sufficient lateral and axial pressure against the drive casing so that the sample barrel and sample liner are held into place while they are driven into the ground. At the same time, the inflated gland absorbs some of the shock of driving, decreasing the wear on the sampler and thus increasing its life.

The gas line connecting the gland of the fluid-coupled latch to the latch control system is polyethylene tubing, which extends from the gland to the surface where it in turn is connected to a cylinder of compressed air or compressed nitrogen. For protection, the inflation tube is encased in a hard rubber sheath along with the wire rope used for retrieval. The inflation tube can then be easily fed into the drive casing along with the wire rope as the sampler is being driven, or retrieved as the sample barrel or sampler is being retrieved.

To provide for continued operation even in the event of a leak in the gland, the latch control system can regulate the gland pressure. The latch control system includes a pressure detector that can detect a drop in pressure at the inflatable gland. If the pressure loss is not too severe, the latch control system can compensate by commanding the gas controller to provide a continuing fluid input. If the leak cannot be overcome in this manner, the latch control system indicates that the system should be brought to the surface for repair. Thus, the pressure feedback system prevents costly mistakes and improves the overall efficiency of the system.

Removal of the sample from the soil is much easier than in the prior art. A retrieval line, typically a wire rope attached to a winch, is shackled to a retrieval cap on the fluid-coupled latch. The wire rope passes through the drive head, encased in a hard rubber sheath along with the inflation tubing. When a sample has been collected and is ready for removal from the sampler, the drive head is removed, the latch is deflated and the fluid-coupled latch and attached sample barrel are drawn up inside the drive casing using the winch.

For a second round of sampling, new sample liners are placed within the sample barrel and the sample barrel is reattached to the fluid-coupled latch to form a sample assembly. The wire rope and inflation tubing are still attached to the fluid-coupled latch. The assembly is then eased into the sample casing, with the inflation tubing and the wire rope lowered by the winch into the drive casing. When the sample barrel seats against the inner lip of the drive shoe, a jerk is felt (or seen) at the surface. The gas flow controller then activates the valve so that the gland of the latch is inflated by the canister of compressed gas. The latch, sample barrel, and drive casing are then driven further into the soil by a hydraulic hammer, hydraulic pressure cylinders, or a vibrator. The sampling process can be continued for as many rounds as desired. After all desired rounds of sampling have been completed, the entire sampling system is removed using the hydraulic pressure cylinders used to drive the sampler. For removal, clamps are attached to the drive casing and the cylinders are operated in reverse.

In a method in accordance with the invention, a fluid-coupled latch is attached to a sample barrel. A sample liner is placed within the sample barrel. The sample barrel with its sample liner and the attached fluid-coupled latch are then placed within the drive casing, and are positioned so that the sample barrel with its sample liner butt against the drive shoe. The fluid-coupled latch is then inflated to secure the barrel in place. The drive casing, sample barrel, sample liners and inflated fluid-coupled latch are driven simultaneously into the soil to essentially the same depth. Thus, all portions of the borehole are sealed off while the sample is obtained, and the sample barrel and liner are secured in place against the drive shoe without the use of inner rods. Further rounds of sampling can continue as desired.

The invention significantly expedites sample taking, as the inner rods are no longer necessary, and need no longer be screwed together every three feet during sampling and unscrewed every three feet during sample retrieval. Instead, the sample barrel and liners are easily retrieved using a winch wireline that is attached to it throughout the sampling procedure. The fluid-coupled latch also acts as a shock absorber, lengthening the life of the sampling equipment. These and other features and advantages of the present invention are apparent in the following description with reference to the drawings below.

DESCRIPTION OF THE PREFERRED EMBODIMENTS

Figure 1:
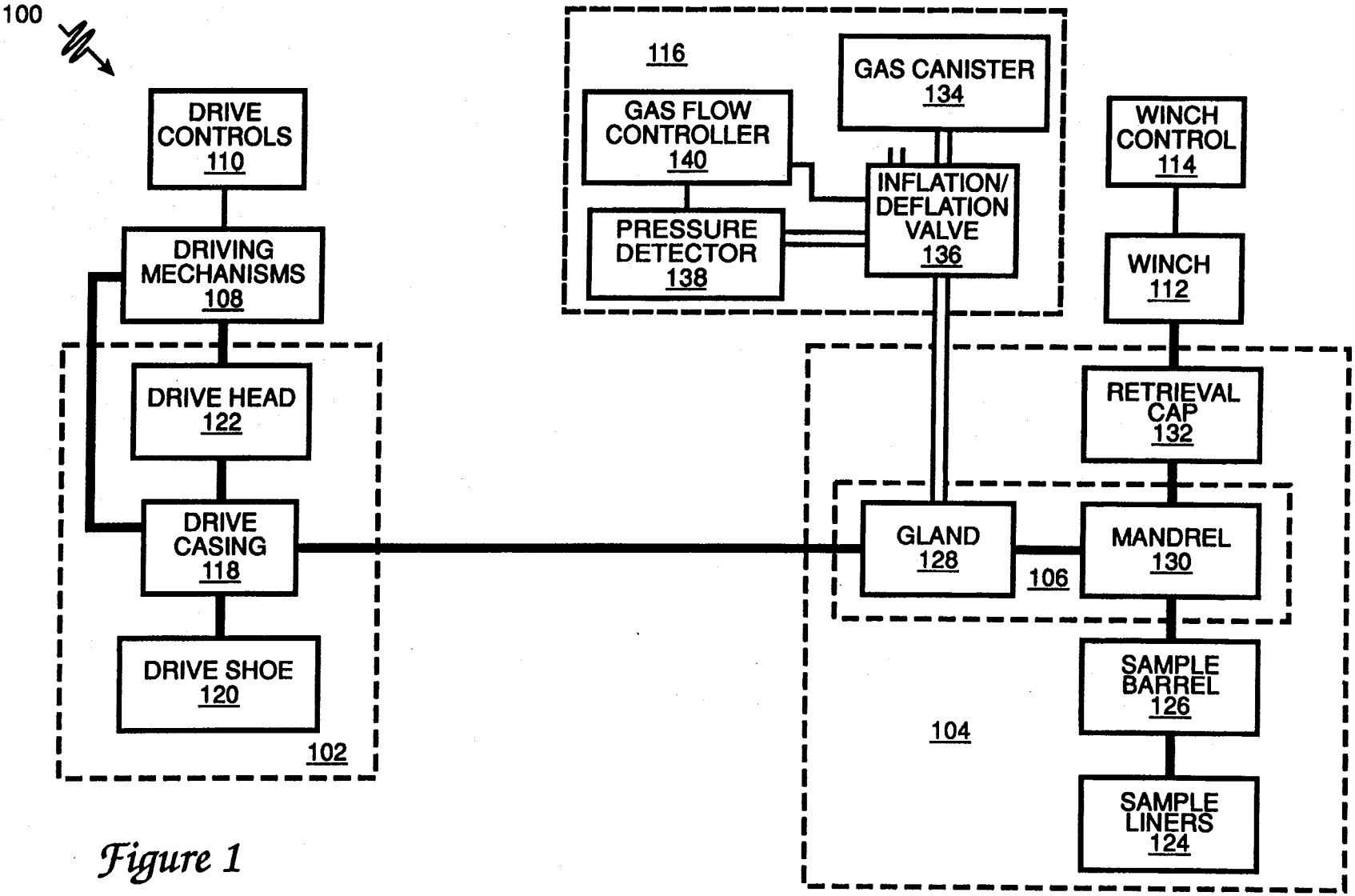
FIG. 1 is a block diagram of a soil sampling system using a fluid-coupled latching system in accordance with the present invention.

In accordance with the present invention, a soil sampling system 100 comprises a casing assembly 102, and a sample assembly 104 including a fluid-coupled latch 106. (The casing assembly and sample assembly together form the sampler.) In addition, soil sampling system 100 comprises a sampler drive system including driving mechanisms 108 and drive controls 110, a sample retrieval system comprising a winch 112 and a winch control 114, and a drive casing retrieval system, which uses driving mechanisms 108 and winch 112, along with their respective controls 110 and 114, as shown in FIG. 1. Soil sampling system 100 also includes a control system 116 for the fluid-coupled latch, as shown in FIG. 1. In FIG. 1, gas line connections are indicated by hollow lines, mechanical connections are indicated by four-point lines between components, and electrical connections are indicated by two-point lines between components.

Drive casing assembly 102 includes a drive casing 118, which can be one or several segments. In the preferred embodiment, each 3' segment of drive casing is a 2.125" outer diameter and 1.687" inner diameter hollow tube of heat-treated steel. One end of each drive casing segment is male-threaded at 2.5 threads per inch with a thread depth of 0.01 inches. The opposite end is female-threaded, so that drive casing segments can be screwed together. A drive shoe 120, attached to the lower end of the drive casing, is wedge shaped to help ease the casing assembly into the soil. A drive head 122 is attached to the top of drive casing 118 to complete casing assembly 102. The casing assembly is used to case off the borehole during sampling. In the following discussion of the apparatus, drive casing assembly 102 is considered to have been driven into the ground previously, for the previous round of sampling. Drive head 122 can be removed while the rest of casing assembly 102 remains in the ground.

For rounds of sampling using fluid-coupled latch 106, sample assembly 104 is prepared by placing sample liners 124 into a sample barrel 126. Preferably, sample barrel 126 is a three-foot long tube of carbon steel with a 1.625" outer diameter and 1.527" inner diameter. Six 6-inch by 1½-inch-diameter stainless steel sample liners 124 fit inside sample barrel 126. Sample liners 124 are dimensioned to be compatible with existing standardized laboratory requirements. Fluid-coupled latch 106 comprises an inflatable gland 128 attached to a mandrel 130. A retrieval cap 132 is attached to the latch. Wire rope runs between retrieval cap 132 and winch 112. The fluid-coupled latch, with retrieval cap, couples to the sample barrel with liners to complete sample assembly 104.

The fluid-coupled latch control system 116 includes a canister 134 of compressed gas, an inflation/deflation valve 136, a pressure detector 138, and a gas flow controller 140. Gas lines run between the canister and the valve, between the valve and the gland, and between the valve and the pressure detector. The valve also has an exhaust gas line for deflation.

The sample assembly is lowered into drive casing 118 before reattaching drive head 122 to the top of the drive casing. To tighten the fluid-coupled latch, gas flow controller 140 causes inflation/deflation valve 136 to enable canister 134 of compressed gas to inflate the inflatable gland on the latch to a predetermined pressure. When fluid-coupled latch 106 is inflated, lateral force and axial friction prevent the sample assembly and the casing assembly from moving axially or rotating relative to each other. In this sense, when the fluid-coupled latch is inflated, it can be said to couple the sample assembly rigidly to the casing assembly.

The sampling assembly and casing assembly can thus be driven into the soil as a unit. The sampling system comprises three driving mechanisms 108: a hydraulic pressure cylinder, a hammer, and a vibration drive. Drive controls 110 operate the driving mechanisms: the hammer strikes the drive head, and the pressure cylinder and vibrators act on the drive casing via clamps. When a soil sample is obtained, the sample (inside the sample assembly) is withdrawn using the sample retrieval system.

To withdraw the sample assembly, drive head 122 is removed and fluid-coupled latch 106 is unlatched from casing assembly 102. Gas controller 140 operates inflation/deflation valve 136 to deflate inflatable gland 128. Winch control 114 is then operated to cause winch 112 to take up wire rope that is shackled to the retrieval cap. The sample assembly is thus withdrawn as a unit from the casing assembly.

The fluid-coupled latch is typically not required for a first round of sampling from the surface. A sample barrel is conventionally sized to fit one segment of drive casing, so the drive head secures the sample barrel (with liners) against the drive shoe. In the first round, the tolerances are usually acceptable and there is no inconvenience with inner rods.

After the sample assembly containing the last round of sample has been retrieved, the drive casing is removed by tightening clamps around the drive casing and operating the pressure cylinder in reverse to pull the casing from the ground. Vibrating drive mechanisms can be used to assist in extracting the drive casing.

Figure 2:
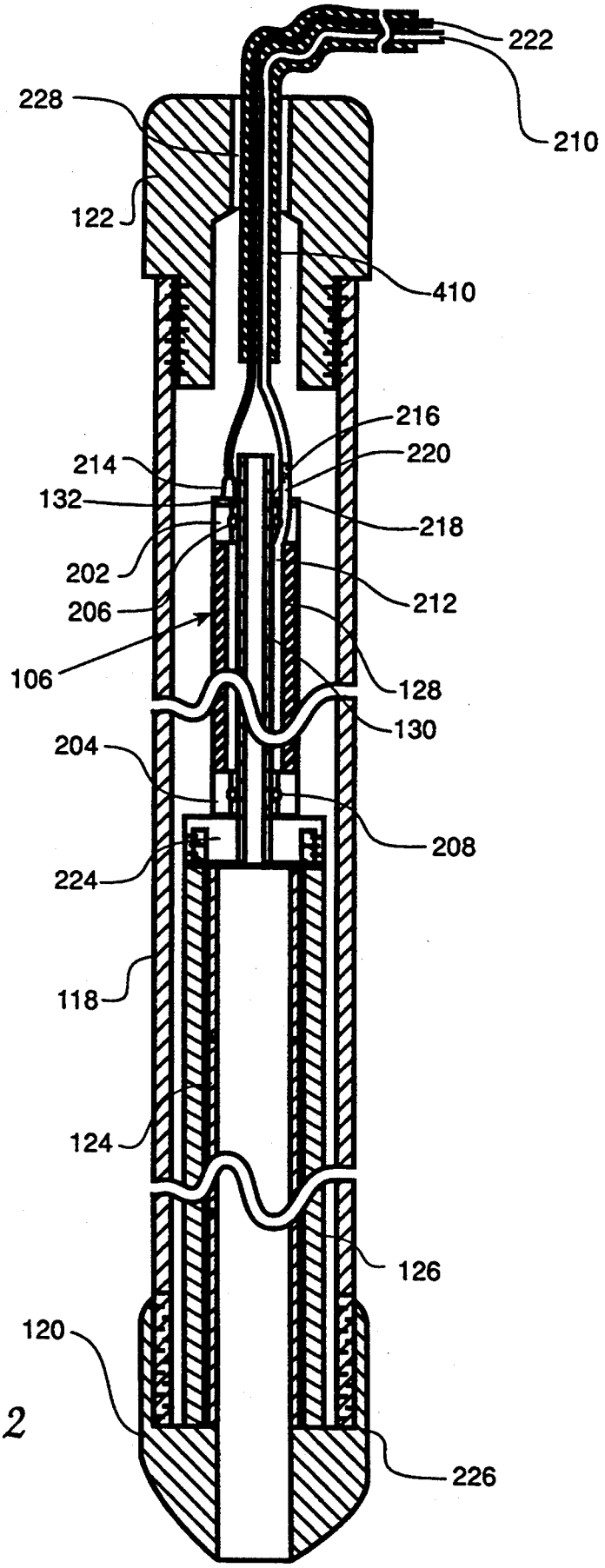
FIG. 2 is a sectional view of a portion of the soil sampler of FIG. 1, showing the fluid-coupled latch.
Figure 3:
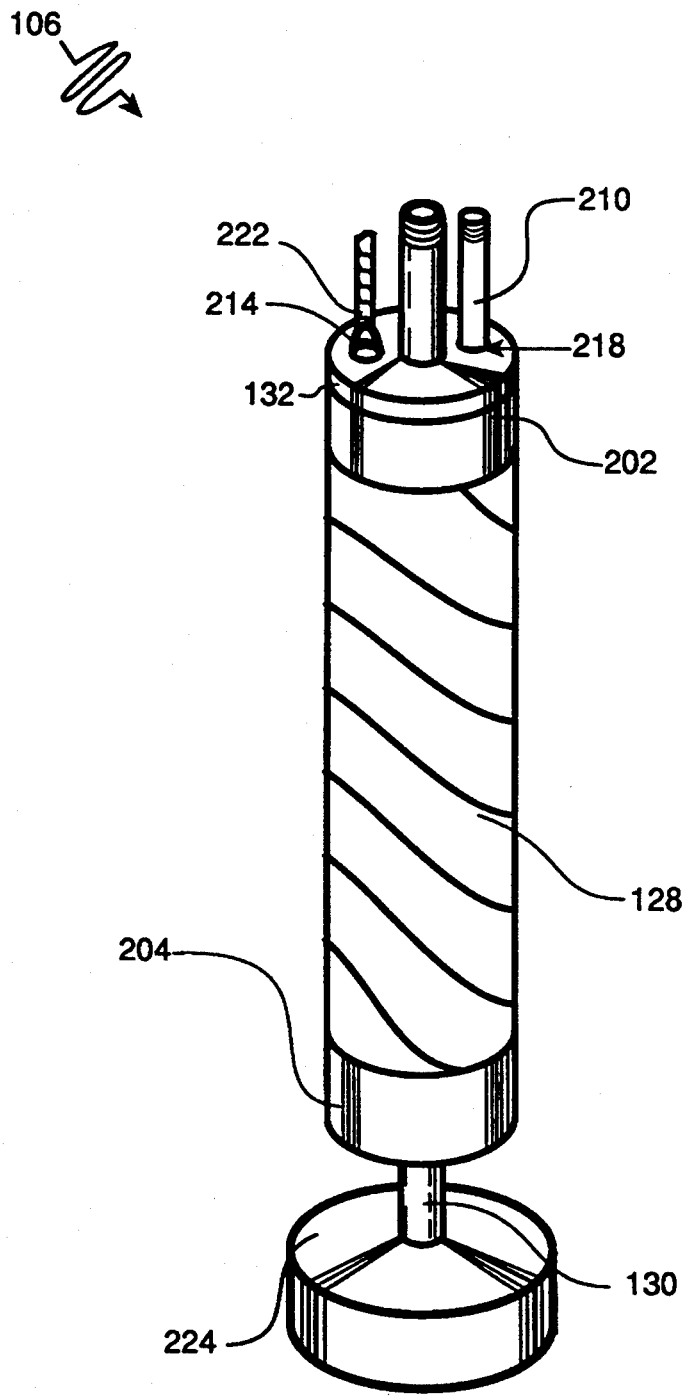
FIG. 3 is a perspective illustration of the latch of the soil sampler of FIGS. 1 and 2.
Figure 4:
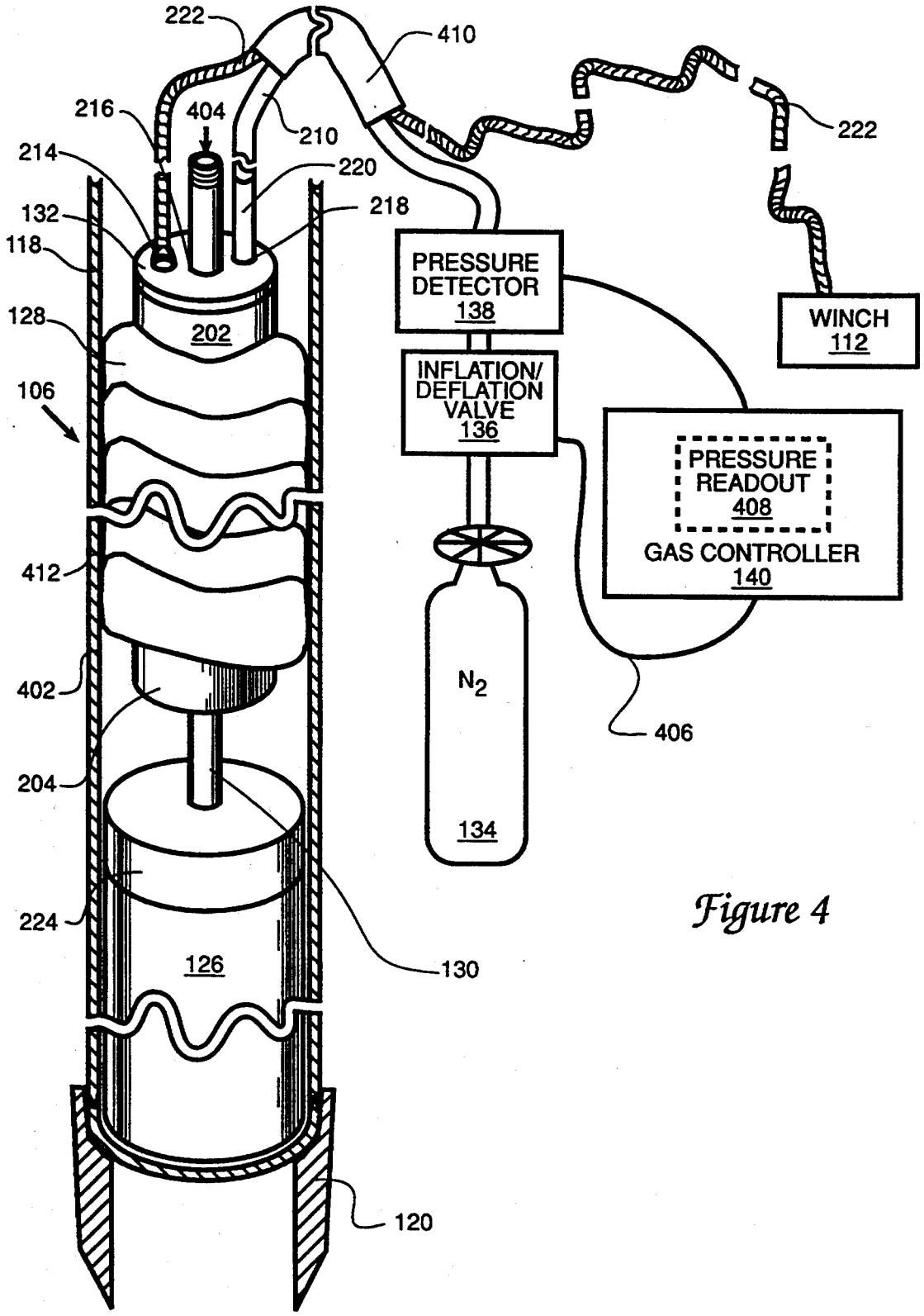
FIG. 4 is a combination cutaway view and block diagram of a portion of the soil sampler of FIG. 1 and 2, illustrating the operation of the fluid-coupled latching system.

Fluid-coupled latch 106 is illustrated in FIGS. 2, 3, and 4. Gland 128 is made of buna rubber for flexibility and strength. Mandrel 130 is a hollow tube of stainless steel. Latch 106 also includes a fixed seal ring 202 and a slidable seal ring 204, as shown in FIGS. 2, 3, and 4. Seal rings 202 and 204 are coupled to inflatable gland 128 and in turn couple gland 128 to mandrel 130. Fixed seal ring 202 includes an upper 0-ring 206 that attaches inflatable gland 128 to the upper end of mandrel 130. Slidable seal ring 204 includes a lower 0-ring 208 that slidably couples inflatable gland 128 to the lower end of mandrel 130. The tightness of the 0-rings on the mandrel determines whether they slide on the mandrel. Rubber seals can be used inside the seal rings to improve the fluid seal against the mandrel. Seal rings 202 and 204 are made of stainless steel, while 0-rings 206 and 208 are made of rubber.

Sample liners 124 line sample barrel 126, as shown in FIG. 2. Sample barrel 126 is then attached to fluid-coupled latch 106 via an assembly coupler 224, shown in FIG. 2. Assembly coupler 224 is female threaded to fit male threading at the top of sample barrel 126. A female-threaded drive shoe 120 can be attached to the male-threaded lower end of drive casing 118. When sample assembly 104 is in place in the drive casing, it rests on an inner lip 226 of drive shoe 120, as seen in FIG. 2.

To inflate gland 128, gas controller 140 sets inflation/deflation valve 136 in inflation position. Compressed gas then flows from gas canister 134 through inflation tubing 210, to an inflation space 212 between mandrel 130 and inflatable gland 128, as seen in FIGS. 2 and 4.

As gland 128 inflates, slidable seal ring 204 slides up mandrel 130. The outermost diameter of the latch (the inflated gland) is increased to engage an inner wall 402 of drive casing 118, as shown in FIG. 4. When fluid-coupled latch 106 is engaged, it exerts sufficient lateral and axial force against drive casing 118 that the latch (with attached sample barrel) and drive casing do not move relative to each other, and can be simultaneously driven into the soil. Mandrel 130 is hollow and open ended, so that its inner space forms a vent 404, as shown in FIG. 4, that vents air displaced when the sample liners fill with soil. In the preferred embodiment, fluid-coupled latch 106 is a "Tigre Tierra" inflatable packer manufactured by Aardvark Corporation at 1415 Meridian East in Puyallup, Wash. 98372-2399.

Gas controller 140 controls inflation/deflation valve 136 via electrical connection 406, and for inflation, causes gas canister 134 to inflate gland 128 to a predetermined pressure, as illustrated in FIG. 4. Pressure detector 138 monitors the pressure in the gland by repeatedly detecting the pressure in a section of inflation tubing 210 near valve 136. Pressure detector 138 transmits the pressure reading to gas controller 140. A microprocessor in gas controller 140 mediates the incoming pressure signals and the outgoing control signals, so that the desired gland pressure can be maintained automatically. Gas controller 140 also includes a pressure readout 408 to provide an operator with information to control the system, as depicted in FIG. 4.

Retrieval cap 132 is welded to the top of fixed seal ring 202, as shown in FIG. 2. Retrieval cap 132 includes a wire rope shackle 214, and includes two apertures 216 and 218 through which mandrel 130 and an inflation port 220, respectively, pass.

Reinforced inflation tubing 210 is polyethylene. Reinforced inflation tubing 210 attaches at one end to canister 134 of compressed gas, and terminates in a threaded end that screws onto inflation port 220, as seen in FIG. 2. A wire rope 222 is shackled to the top of retrieval cap 132, as shown in FIG. 2. The other end of wire rope 222 is attached to winch 112, as depicted in FIG. 4. Inflation tubing 210 and wire rope 222 are encased within a hard rubber sheath 410 so that the inflation tubing can be retrieved simultaneously with the wire rope, as shown in FIG. 4.

A male-threaded drive head 122 screws onto the female-threaded upper end of drive casing 118, rigidly coupling the drive head and drive casing, as seen in FIG. 2. Drive head 122 includes an aperture 228 through which the wire rope and inflation tubing pass, as shown in FIG. 2. Aperture 228 allows drive head 122 to be screwed onto or unscrewed from the top of the drive casing with the wire rope and inflation tubing in place. Aperture 228 opens on the edge of the top of drive head 122 so that the inflation tubing and wire rope are out of the way of the hydraulic hammer drive. One or a combination of the driving mechanisms are then used to advance drive head 122, drive casing 118, and sample barrel 126 (along with sample liners 124) simultaneously into the soil. The driving mechanisms can be operated singly or in any combination.

The fluid-coupled latch replaces many intricate pieces and connections in the prior art. The system no longer requires an expansion coupler, inner rods, or spacers.

Figure 5:
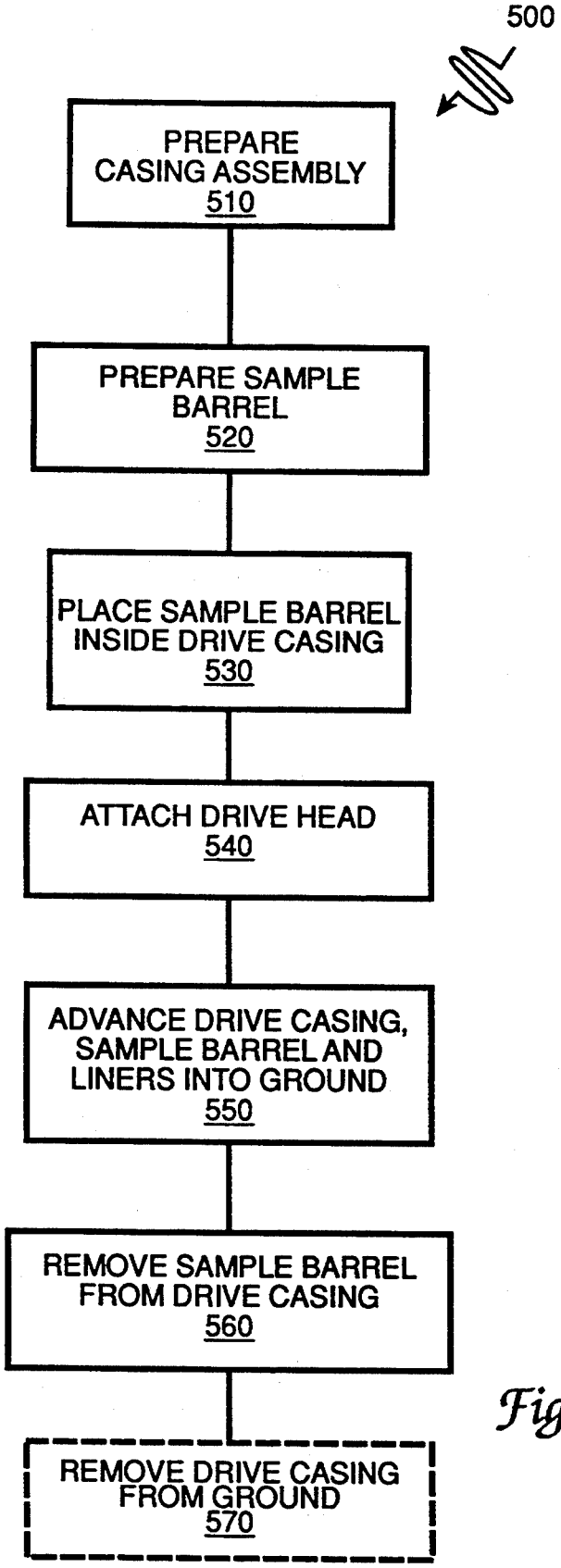
FIG. 5 is a flow chart of a first round of soil sampling, shown to give a context to the use of the fluid-coupled latching system of FIG. 1.
Figure 7:
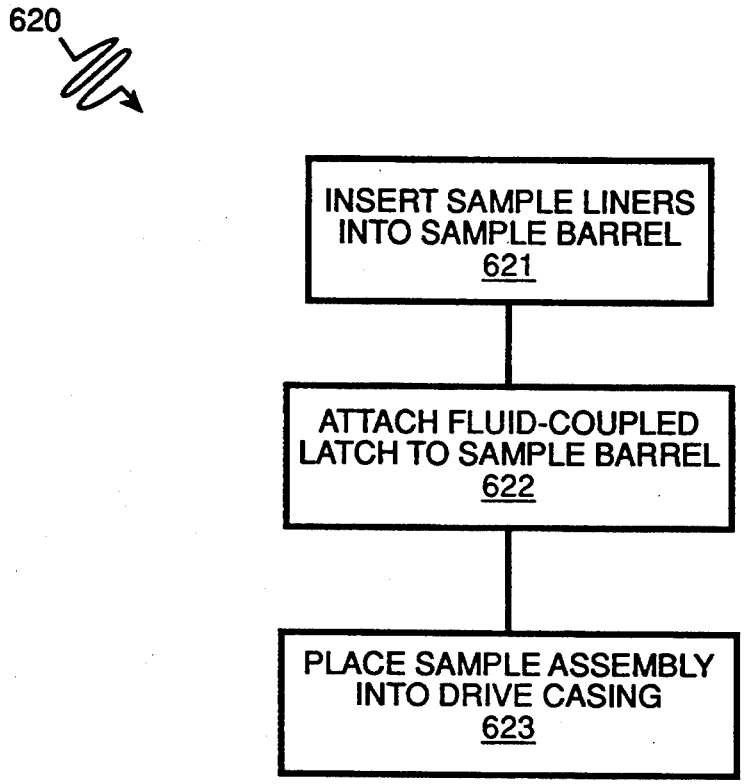
FIG. 7 is a flow chart of substeps of step 620 of the method of FIG. 6.
Figure 8:
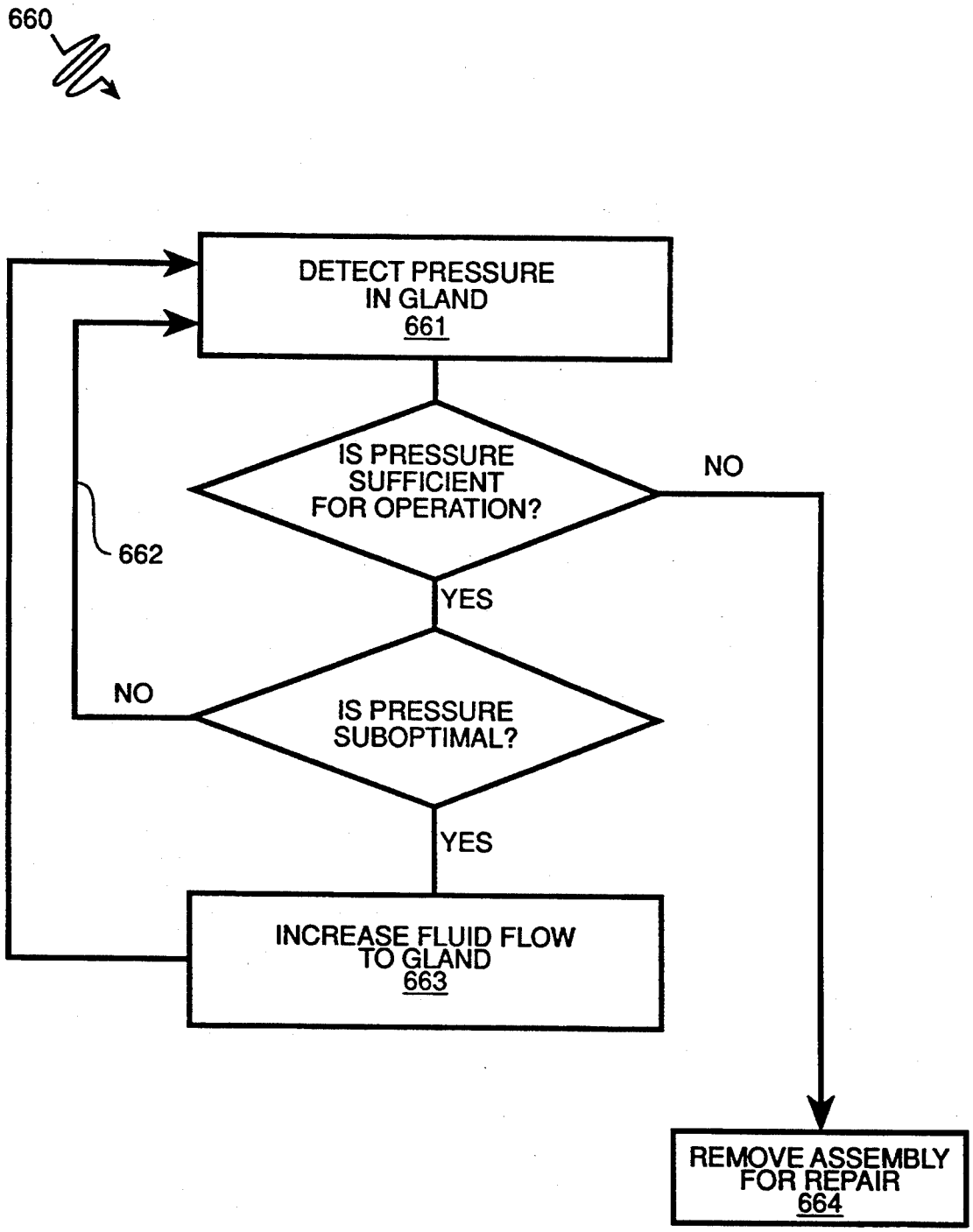
FIG. 8 is a flow chart of substeps of step 660 of the method of FIG. 6.
Figure 9:
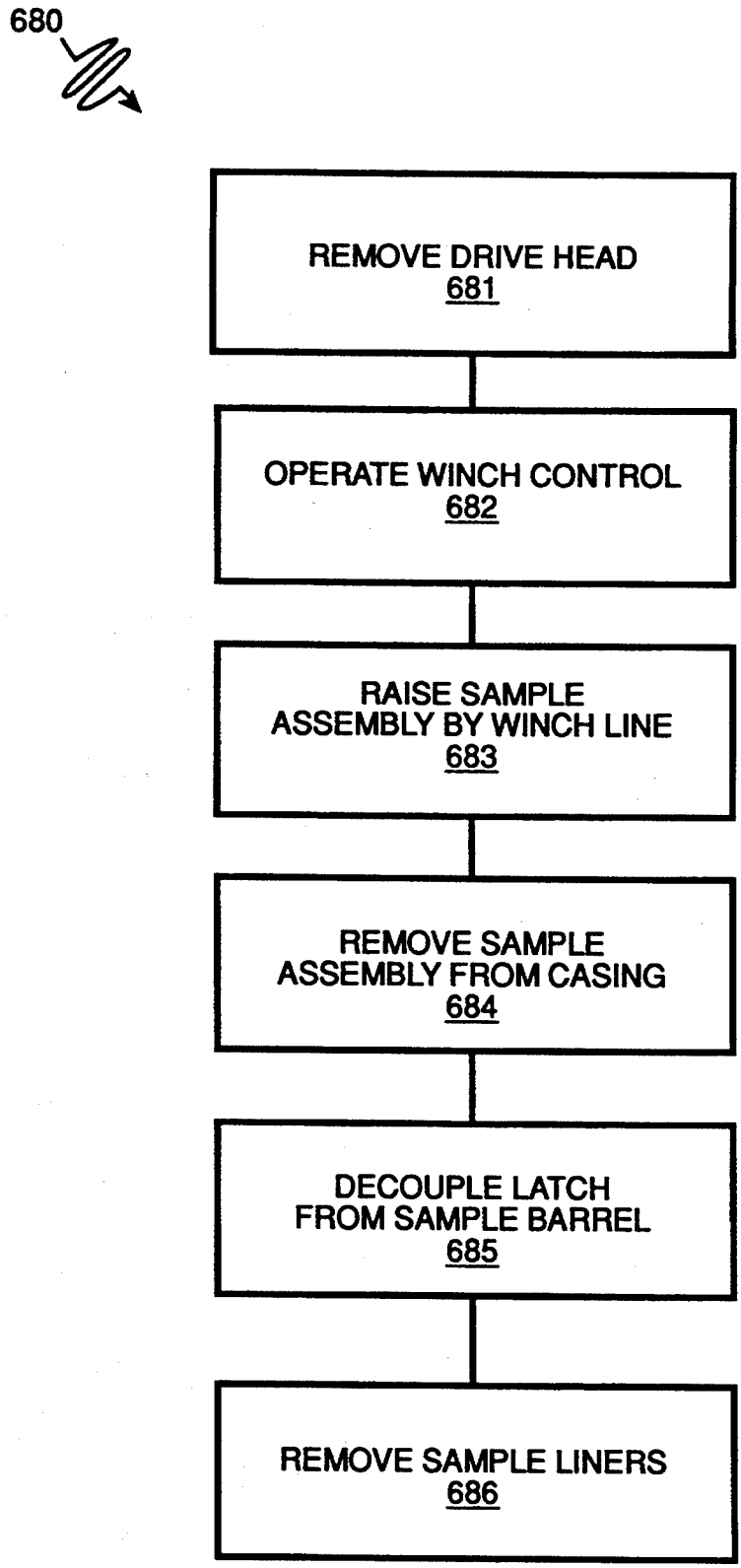
FIG. 9 is a flow chart of substeps of stop 680 of the method of FIG. 6.

A method 500 of the first round of sampling is sketched, for context, in FIG. 5. The fluid-coupled latch is typically not used in a first round of sampling from the surface. A method 600 of sampling using the fluid-controlled latch of the invention is shown in overview in FIG. 6. More detailed substeps of method 600 are shown in FIGS. 7, 8, and 9.

For a first round of sampling, the casing assembly is prepared, at step 510, by attaching a drive shoe to a length of drive casing, as shown in FIG. 5. The sample barrel is prepared, at step 520, by placing sample liners into the sample barrel. The sample barrel is placed inside the drive casing, at step 530. The drive head is attached, at step 540, to the top of the drive casing so as to hold the sample barrel (and liners) in place against the drive shoe. The casing, sample barrel, and liners are then driven, at step 550, into the ground as a unit. In the preferred embodiment, the bottom edges of drive casing 118, sample barrel 126, and sample liners 124 are at the same level, with the bottom edge of drive shoe extending about 1.8" below that level. In other embodiments, the bottom edge of drive casing 118 can extend up to 12" below the bottom edge of sample liners 124.

After a sample has been obtained, the sample barrel (with soil-filled liners) is removed, at step 560, from the drive casing. The sample can be sent to a laboratory for analysis. If only one round of sampling is to be performed, the drive casing is removed, at step 570, from the ground. Because step 570 is an alternative, it is represented by dashed lines. If more than one round of sampling is to be performed, the method proceeds to FIG. 6 after step 560.

Figure 6:
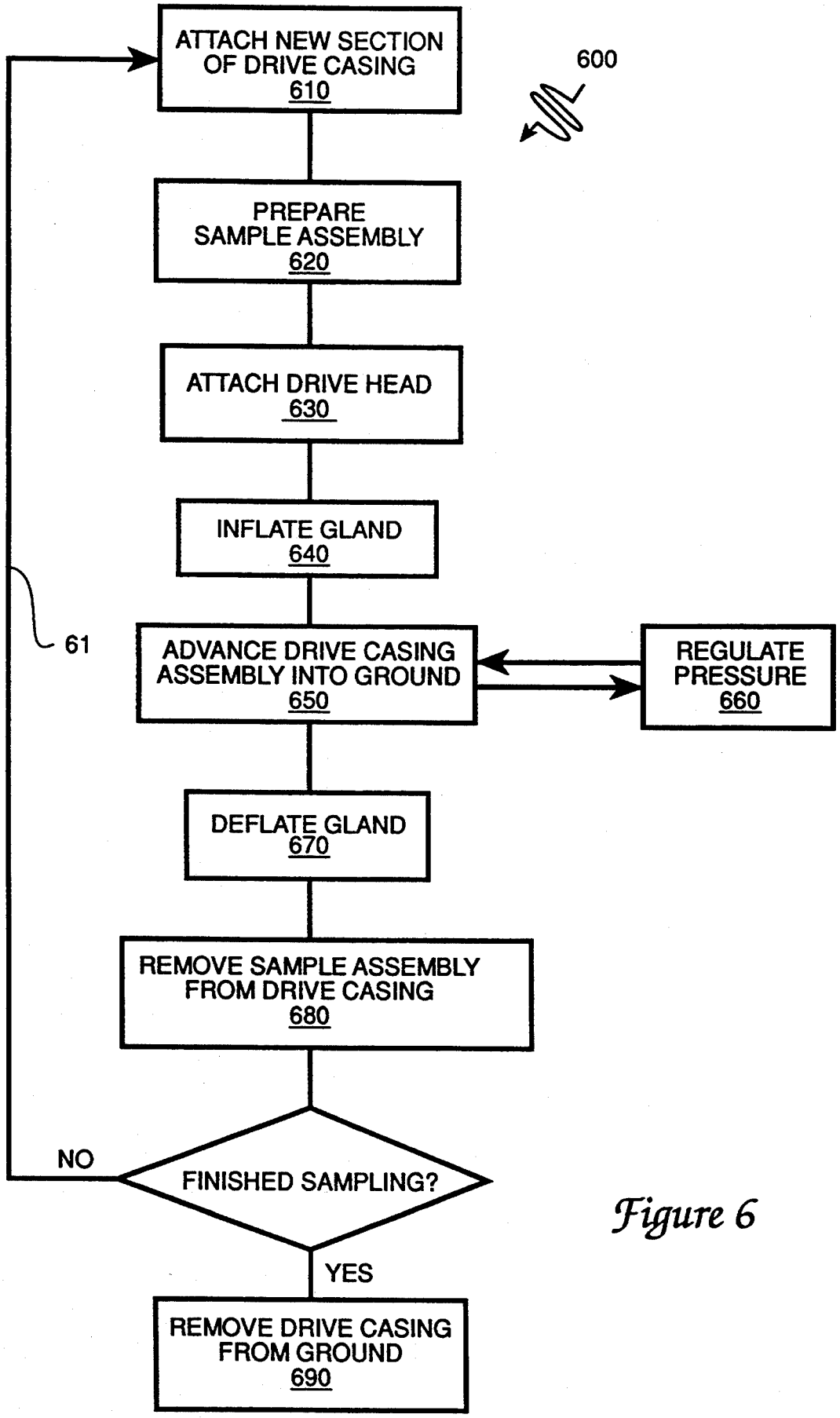
FIG. 6 is a flow chart of rounds of sampling subsequent to the round shown in FIG. 5, illustrating the use of the fluid-coupled latching system of FIG. 1.

A method 600 of the invention is shown in FIG. 6. The steps of method 600 are broken down into more detailed substeps in FIGS. 7, 8, and 9. The sampling proceeds as follows. A new section of drive casing is screwed onto the top of the drive casing, at step 610, as shown in FIG. 6. At step 620, a sample assembly is prepared, as shown in FIG. 6. The following substeps 621–623 of step 620 are undertaken to prepare the assembly: Sample liners 124 are inserted, at substep 621, into sample barrel 126, as shown in FIG. 7. Fluid-coupled latch 106 is attached, at a substep 622, to sample barrel 126, to form sample assembly 104. The sample assembly is placed, at substep 623, into drive casing 118. Drive head 122 is then attached, at a step 630.

The gland is inflated, at step 640, as shown in FIG. 6. The drive casing, fluid-coupled latch, and sample barrel are driven, at step 650, into the soil. The pressure, hammer, and vibration driving mechanisms can be operated singly or in any combination. The selection of drive mechanisms is operator controlled, based on soil conditions and monitoring of the driving process.

The gland pressure is regulated during the sampling procedure, as shown at step 660 in FIG. 6. Substeps 661–664 of step 660 are shown in FIG. 8. The gland pressure is detected, at a substep 661. If the pressure is within a range predetermined to be optimal to latch the assembly to the drive casing (e.g., the pressure is above a predetermined high threshold), the sampling proceeds according to steps 650–690, and the pressure continues to be monitored, as indicated by pathway 662, throughout the sampling. If the pressure is suboptimal but above a predetermined low threshold, the gas flow to the gland is increased, at a substep 663. If the gland maintains sufficient pressure (e.g., is between the low threshold and the high threshold), gas continues to flow to the gland, the pressure continues to be monitored by the pressure detector, and the sampling continues. However, if the pressure is insufficient, e.g., below the predetermined low threshold, a major leak in the gland is indicated. The sampling is aborted, and the assembly is removed, at a substep 664, for repair or replacement. In this way, increased gas flow can correct for temperature fluctuations causing pressure drops, or ameliorate a situation where the gland was initially insufficiently inflated. The regulation can also counteract a minor leak in the gland and enable sampling to continue. Furthermore, major problems are recognized and can be remedied at an early stage.

As the sample assembly and casing assembly is driven into the soil, sample liners 124 become filled with soil. When sample liners 124 within sample assembly 104 fill with a soil sample, the sample is retrieved.

To prepare for retrieval of the sample assembly, gas controller 140 signals inflation/deflation valve 136 to deflate inflatable gland 128 of fluid-coupled latch 106, at step 670, as seen in FIG. 6. When gland 128 is deflated, fluid-coupled latch 106 disengages from inner wall 402 of drive casing 118. The sample assembly is then removed, at step 680, from the drive casing. The removal proceeds according to substeps 681–686, as shown in FIG. 9. The drive head is removed, at substep 681, from the top of the drive casing. Winch control 114 is operated, at a substep 682, to activate winch 112, which rotates to spool wire rope 222 and reinforced inflatable tubing 210 within sheath 410. Aperture 228 in drive head 122 allows the sheath to pass easily through. As the wire rope and tubing are withdrawn from the drive casing, fluid-coupled latch 106 and sample barrel 126 are drawn up, at a substep 683, inside the drive casing, The sample assembly can then be removed, at substep 684, from the drive casing.

Latch 106 is decoupled from sample barrel 126, at substep 685. Soil-filled sample liners 124 are removed, at substep 686, from sample barrel 126, and can then be sent to a laboratory for testing and analysis. The round of sampling is now complete. The procedure can be repeated, as indicated by pathway 61, for additional rounds of sampling, as seen in FIG. 6.

When all rounds of sampling are finished, the remaining sampler components are removed from the ground, at step 690. To effect removal, pressure cylinders (used to advance the sample assembly and casing assembly into the ground) are extended to pull drive casing 118 several feet from the borehole. The upper segment of drive casing is removed, and the drive casing removal procedure repeated.

Figure 10:
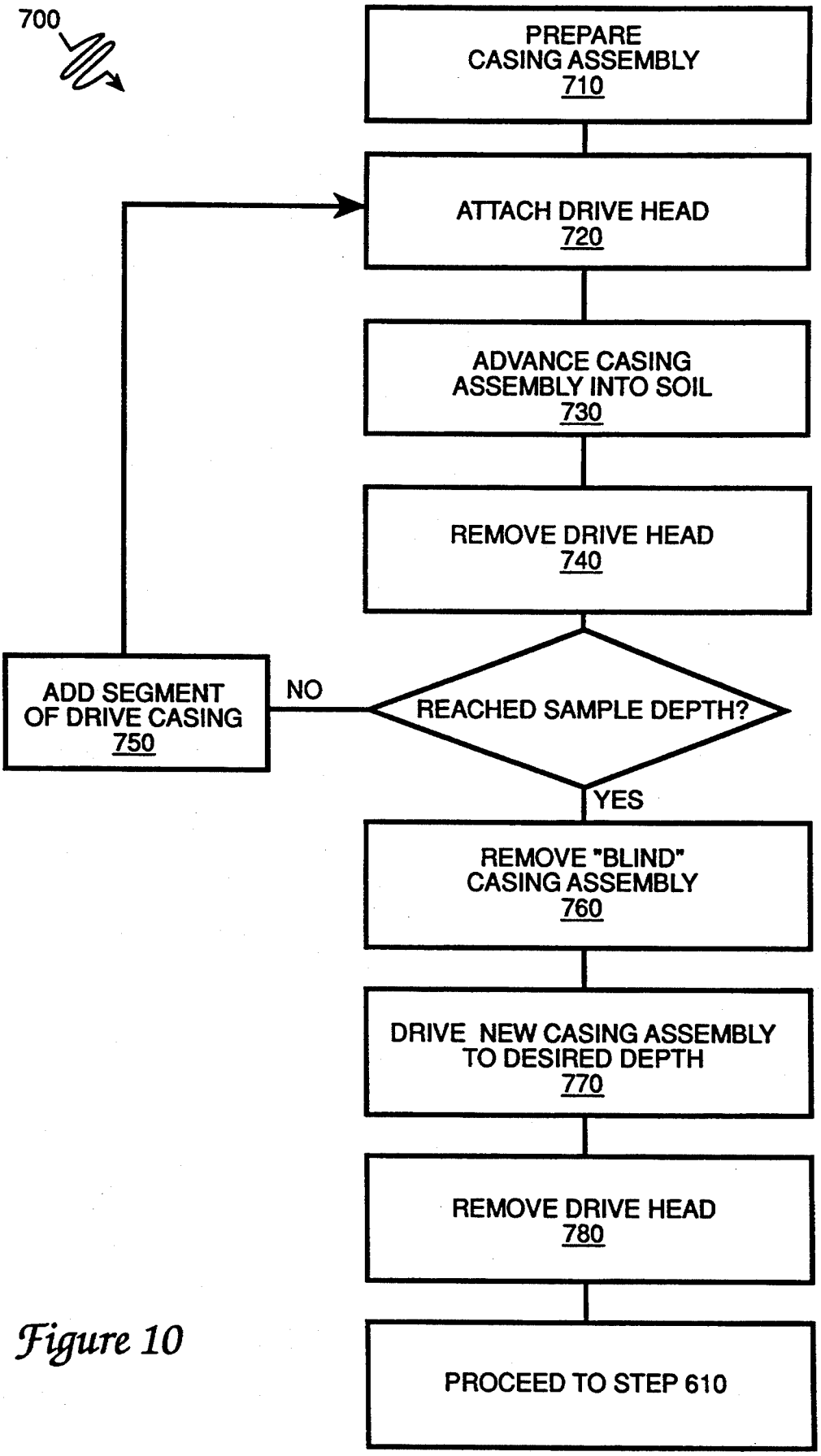
FIG. 10 is a flow chart of a method, used in conjunction with method 600, of obtaining a sample beginning at a point below the surface of the ground.

In the case where the sampling begins at a point below the surface, a method 700, as shown in FIG. 10, is used in conjunction with steps from method 600, shown in FIG. 6. The procedure is as follows: A solid drive shoe, without an inner bore, is attached to drive casing 118, at a step 710. Drive head 122 is then screwed onto drive casing 118, at a step 720. The drive casing is then driven into the soil by one or a combination of the driving mechanisms, at a step 730. The drive head is removed, at step 740. If desired, further segments of drive casing can be added, at a step 750, and steps 720–750 can be repeated until a desired sample depth is reached. Soil does not enter the drive shoe or drive casing, and is displaced into the borehole wall.

When the desired initial sample depth is reached, the drive casing assembly with the solid drive shoe is removed, at a step 760. A new casing assembly with an open drive shoe is driven to the prepared depth, at step 770. Drive head 122 is then removed, at step 780. From this point on, steps of the method are as shown in FIG. 6 steps 610–690 (including optional pathway 61), and their associated substeps as shown in FIGS. 7, 8, and 9. A new section of drive casing is attached, sample assembly 104 is prepared and lowered into the casing assembly, and drive head 122 is then reattached, at steps 610, 620 and 630. Inflatable gland 128 is inflated, at a step 640, via reinforced inflation tubing 210 using compressed gas from canister 134, to latch the sample barrel in the drive casing. Sample assembly 104 and casing assembly 102 can then be driven deeper into the soil, at a step 650, by applying driving forces from one or a combination of driving mechanisms 108. The pressure is regulated at step 660. The gland is deflated at step 670 and the sample removed, at a step 680. Further rounds of sampling can proceed via pathway 61, and/or the casing assembly can be retrieved at step 690.

Materials other than buna rubber can be used for the inflatable gland of the fluid-coupled latch. The pressure need not be detected or monitored, or can be monitored intermittently. The system is compatible with standard sample liners as preferred by testing laboratories, but can be used with other sample liners. Alternatively, the invention does not require a separate sample barrel and liners; one cylinder can suffice for both functions. Except where particularly specified, the term "drive" applied to advancing the soil sampler comprises all methods of advancing the sampler, including pounding, hammering, continuous pressure, intermittent pressure, and vibration.

The retrieval cap need not be a separate piece. A retrieval shackle can be attached directly to the upper seal ring, or elsewhere on fluid-coupled latch 106. Retrieval methods other than a winch system can be used to retrieve the sample assembly.

Materials other than steel can be used to manufacture the drive casing, sample container, and liners. The drive mechanisms of the invention can be configured in many different ways, so long as the claimed functions are enabled. Normally, it is contemplated that the sampler will be driven straight down or at a small angle from the vertical. However, the invention provides for drilling at greater angles from the vertical, horizontally, and even in an upward direction. Each sample has a minimum depth from surface and a maximum depth from the surface. When the sampler is driven straight down, the maximum depth is at the bottom of the sample. When the sampler is driven horizontally, the maximum sample depth is the furthest distance of the sample from the surface through which the sample was accessed.

The system is compatible with other uses of accessing subsurface volumes. The system can be used to measure or collect groundwater samples. For example, a piezometer can be disposed within the drive casing after the sample barrel has been removed and prior to removing the drive casing. The piezometer can then be used to measure water levels. Similarly, a soil vapor extraction well can be disposed within the drive casing after the sample barrel has been removed. The soil vapor extraction well can then be used to extract vapor samples.

The system can be used in soil venting. Soil venting is typically used to increase the activity of bacteria already in the soil. The bacteria consume hydrocarbons, and soil venting is used to accelerate the process of cleaning the soil. To vent soil, a length of perforated small-diameter polyvinyl chloride (PVC) pipe, sized to fit the inner diameter of drive casing 118, can be disposed within the drive casing instead of a sample barrel and liners after the sample barrel has been removed and prior to removing the drive casing. Bacterial nutrients such as oxygen and nitrogen can then be pumped into the soil. In some cases, the temperature can be elevated to improve bacterial activity. The pipe need not be PVC and need not be perforated.

In the description above, the latch is not used in a first round of sampling from the surface only because the system uses standard sized drive casing and sample barrel lengths. The system can be reconfigured, for example by shortening the sample barrel and latch or increasing the initial length of drive casing and repositioning the driving mechanisms, so that the latch can be used in a first round of sampling from the surface.

The inflation/deflation valve can be one valve or a series of valves. The inflatable gland can include an inflation space between rubber and metal, or between rubber and another unyielding surface such as plastic. Alternatively, the inflation space of the gland can be between two yielding surfaces, as in a balloon. The latch and/or the gland can be reinforced by various resilient materials to lessen the chance of puncture. Other means for inflating and deflating the gland, e.g. by regulating gas volume through temperature control, can be used.

The gland can be inflated with compressed gas or liquid. The latch need not be a gland-mandrel assembly, but can include an inflatable gland attached directly to the sample barrel. Other latch designs and other gland designs can be used, so long as the inflated gland engages the drive casing so as to preclude relative motion between them. Mandrel 130 can have a groove to better engage fixed O-ring 206.

These and other modifications to and variations upon the described embodiments are provided for by the present invention, the scope of which is limited only by the following claims.

What is claimed is:

1. A method for collecting a subsurface sample using a sample container and a drive casing, comprising the steps of (a) coupling an inflatable gland to said sample container;

(b) placing said sample container with said attached inflatable gland inside said drive casing;

(c) introducing fluid into said inflatable gland so as to inflate said inflatable gland so that said sample container is held in a fixed position relative to said drive casing;

(d) driving said drive casing so that said gland while inflated forces said sample container to a maximum sample depth; and (e) removing said sample container from said drive casing.

2. A method as described in claim 1 further involving the step of before said removing step, deflating said inflatable gland so as to decouple said sample container and said drive casing.

3. A method as described in claim 1 wherein step (d) further involves the substeps of:

detecting the pressure in said inflatable gland; and when said detected pressure is below a first threshold, removing said inflatable gland for repair or replacement.

4. A method as described in claim 1 wherein step (d) further involves the substeps of:

monitoring the pressure in said inflatable gland; and when said detected pressure is above a first threshold but below a second threshold, introducing more fluid into said inflatable gland.

5. A method for collecting a continuous sample of soil comprising the steps of:

coupling a sample container and a drive casing into a fixed position relative to each other by inflating an inflatable gland;

driving said drive casing so that said gland while inflated forces said sample container to a first sample bottom depth;

deflating said inflatable gland so that said drive casing and sample container are no longer coupled into a fixed position;

removing said sample container from said drive casing;

coupling a second sample container to said drive casing by reinflating said inflatable gland; and driving said drive casing so that said gland while inflated forces said second sample container to a second sample bottom depth.

6. A method for collecting a soil sample comprising the steps of:

inserting sample liners into a sample barrel;

attaching a winch line connected to a winch to said sample barrel;

placing said sample barrel with attached winch line into a drive casing;

inflating an inflatable gland to rigidly couple said sample barrel and said drive casing;

detecting the pressure in said inflatable gland;

attaching a drive head means for driving said drive casing into soil to be sampled;

while said gland is inflated so as to rigidly couple said sample barrel and said drive casing, driving said drive casing means so that said sample barrel is driven into soil;

deflating said inflatable gland; and retracting said sample barrel and said sample liners from said drive casing using said winch line and winch.

7. An apparatus for collecting a soil sample comprising:

drive casing means for casing off a borehole;

sample container means for containing a soil sample obtained from said borehole;

inflatable gland means for, while inflated, rigidly coupling said sample container means to said drive casing means, so that, when said drive means drives said drive casing, said sample container means is forced into the ground by the rigid coupling provided by said inflatable gland while inflated.

8. An apparatus for collecting a soil sample comprising:

drive casing means for casing off a borehole;

sample container means for containing a soil sample obtained from said borehole;

inflatable gland means for attaching said sample container means and said drive casing means in a fixed position relative to each other;

detector means for detecting the pressure in said inflatable gland means; and drive means for driving said drive casing means;

whereby, the rigid coupling provided by said gland forces said sample container into soil.

9. An apparatus as described in claim 8 further including a monitor means for monitoring the pressure in said inflatable gland means.

10. An apparatus as described in claim 8 wherein said drive means includes a pressure drive means, a hammer drive means, and a vibratory drive means.

11. An apparatus as described in claim 10 wherein said drive means further includes means for operating said pressure drive means, said hammer drive means, and said vibratory drive means singly or in any combination to drive said sample container into soil.

* * * * *